US011753707B2

(12) United States Patent
Wang

(10) Patent No.: US 11,753,707 B2
(45) Date of Patent: Sep. 12, 2023

(54) AMORPHOUS STRIP MASTER ALLOY AND METHOD FOR PREPARING SAME

(71) Applicants: Jingran Wang, Beijing (CN); Jiahao Wang, Beijing (CN); Jiahui Wang, Beijing (CN)

(72) Inventor: Jingran Wang, Beijing (CN)

(73) Assignees: Jingran Wang, Beijing (CN); Jiahao Wang, Beijing (CN); Jiahui Wang, Beijing (CN)

( * ) Notice: Subject to any disclaimer, the term of this patent is extended or adjusted under 35 U.S.C. 154(b) by 114 days.

(21) Appl. No.: 17/421,368

(22) PCT Filed: Jan. 9, 2020

(86) PCT No.: PCT/CN2020/071117
§ 371 (c)(1),
(2) Date: Jul. 7, 2021

(87) PCT Pub. No.: WO2020/143703
PCT Pub. Date: Jul. 16, 2020

(65) Prior Publication Data

US 2022/0064763 A1 Mar. 3, 2022

(30) Foreign Application Priority Data

Jan. 9, 2019 (CN) ..... 201910020121.5

(51) Int. Cl.

| | |
|---|---|
| ***C22C 33/00*** | (2006.01) |
| ***C22C 1/02*** | (2006.01) |
| ***C22C 35/00*** | (2006.01) |
| ***C22C 45/02*** | (2006.01) |

(52) U.S. Cl.
CPC ..... *C22C 33/003* (2013.01); *C22C 1/02* (2013.01); *C22C 35/005* (2013.01); *C22C 45/02* (2013.01)

(58) Field of Classification Search
None
See application file for complete search history.

(56) References Cited

U.S. PATENT DOCUMENTS

| | | | | |
|---|---|---|---|---|
| 2010/0188186 | A1 | 7/2010 | Urata et al. | |
| 2012/0067468 | A1* | 3/2012 | Iorio | H01F 41/0246 148/561 |
| 2019/0010586 | A1 | 1/2019 | Kim et al. | |

FOREIGN PATENT DOCUMENTS

| | | | |
|---|---|---|---|
| CN | 101226802 | A | 7/2008 |
| CN | 102808140 | A | 12/2012 |
| CN | 102936705 | A | 2/2013 |
| CN | 103119665 | A | 5/2013 |
| CN | 103643179 | A | 3/2014 |
| CN | 105314726 | A | 2/2016 |
| CN | 105695884 | A | 6/2016 |
| CN | 106636982 | A | 5/2017 |
| CN | 106636983 | A | 5/2017 |
| CN | 108431277 | A | 8/2018 |
| CN | 109652746 | A | 4/2019 |
| EP | 2320436 | A1 | 5/2011 |
| EP | 2612334 | A1 | 7/2013 |
| JP | 2018167298 | A | 11/2018 |
| RU | 2706081 | C1 | 11/2019 |
| WO | 2012030803 | A1 | 3/2012 |
| WO | 2018030582 | A1 | 2/2018 |

OTHER PUBLICATIONS

International search report of PCT application No. PCT/CN2020/071117 dated Apr. 8, 2020.
First office action of Chinese application No. 201910020121.5 dated May 29, 2020.
Second office action of Chinese application No. 201910020121.5 dated Jan. 22, 2021.
Wenhua Lu, Cast Iron and its Smelting, Machinery Industry Press; Apr. 30, 1981, p. 175.
Dan Chen et al., Metallography and Heat Treatment, Beijing Institute of Technology Press; Nov. 30, 2017, p. 104.
First Office Action of Chinese Application No. 202080008752.6, dated Mar. 28, 2022, in 16 pages.
Extended European search report of counterpart EP application No. 20738607.9 dated Oct. 29, 2021.
Search Report and Office Action of Russian application No. 2021123141/05 dated May 5, 2023.

* cited by examiner

*Primary Examiner* — Brian D Walck
(74) *Attorney, Agent, or Firm* — Knobbe, Martens, Olson & Bear, LLP

(57) ABSTRACT

Provided is a method for preparing an amorphous strip master alloy. The method includes: providing an amorphous alloy and cementite $Fe_3C$; and placing the amorphous alloy and the cementite $Fe_3C$ in a smelting furnace for smelting treatment to obtain the amorphous strip master alloy, wherein elements constituting the amorphous alloy include Fe element, Si element and B element. An amorphous strip master alloy prepared by the preparation method is also provided.

19 Claims, No Drawings

AMORPHOUS STRIP MASTER ALLOY AND METHOD FOR PREPARING SAME

CROSS-REFERENCE TO RELATED APPLICATION

This application is a US National Phase application of International Application No. PCT/CN2020/071117, filed on Jan. 9, 2020, which claims priority to the Chinese Patent Application No. 201910020121.5, filed on Jan. 9, 2019 and entitled "AMORPHOUS STRIP MASTER ALLOY AND PREPARATION METHOD THEREOF", the disclosure of each of which is herein incorporated by reference in its entirety.

TECHNICAL FIELD

The present disclosure relates to the field of amorphous materials, and in particular to an amorphous strip master alloy and a method for preparing same.

BACKGROUND

Metal materials generally include crystalline materials and amorphous materials. Thin strip materials made of amorphous materials are referred to as amorphous strips, which have the advantages of high strength, high hardness, high plasticity and the like. In the preparation of the amorphous strips, the amorphous raw materials as used are usually referred to as amorphous strip master alloys.

SUMMARY

Embodiments of the present disclosure provide an amorphous strip master alloy and a method for preparing same. The technical solutions are as follows:

Specifically, the present disclosure includes the following technical solutions:

In one aspect, a method for preparing an amorphous strip master alloy is provided. The preparation method includes: providing an amorphous alloy and cementite $Fe_3C$; and placing the amorphous alloy and the cementite $Fe_3C$ in a smelting furnace for smelting treatment to obtain the amorphous strip master alloy, wherein elements constituting the amorphous alloy include Fe element, Si element and B element.

In a possible implementation, the preparation method further includes:

providing iron nitride $Fe_3N$; and placing the amorphous alloy, the cementite $Fe_3C$ and the iron nitride $Fe_3N$ in the smelting furnace for smelting treatment.

In a possible implementation, the amorphous alloy is an Fe—Si—B alloy.

In a possible implementation, the elements constituting the amorphous alloy further include at least one of Cu element, Nb element or Ni element.

In a possible implementation, the amorphous alloy is an Fe—Si—B—Nb alloy.

In a possible implementation, the amorphous alloy is an Fe—Ni—Si—B alloy.

In a possible implementation, the amorphous alloy is an Fe—Cu—Nb—Si—B—Ni alloy.

In a possible implementation, a mass ratio of the amorphous alloy to the cementite $Fe_3C$ is 1:0.005-0.5.

In a possible implementation, a mass ratio of the Fe—Si—B alloy to the cementite $Fe_3C$ is 1:0.005-0.5.

In a possible implementation, during the smelting treatment, a smelting temperature is in a range of 1300° C. to 1500° C. during the smelting treatment.

In a possible implementation, the cementite $Fe_3C$ is provided by using a cementite $Fe_3C$ finished product or white iron.

In a possible implementation, the cementite $Fe_3C$ is provided by simultaneously using white iron and a cementite $Fe_3C$ finished product.

In a possible implementation, in the Fe—Si—B alloy, atomic percentages of the respective elements are as follows:

Si 6-12 at %, B 3-14 at %, and the balance being Fe.

In a possible implementation, in the Fe—Si—B alloy, the atomic percentages of the respective elements are as follows:

Si 6-12 at %, B 8-14 at %, and the balance being Fe.

In a possible implementation, the amorphous alloy, the cementite $Fe_3C$, and the iron nitride $Fe_3N$ are in a powder or block form.

In a possible implementation, a particle size of the powder is nanometer level.

In a possible implementation, the particle size of the powder is in a range of 5 nanometers to 50 nanometers.

In a possible implementation, the amorphous alloy is an Fe—Si—B alloy.

In a possible implementation, the Fe—Si—B alloy powder is obtained by:

performing embrittlement, heat treatment, mechanical crushing, and jet crushing on an iron-based amorphous alloy strip sequentially to obtain the Fe—Si—B alloy powder.

In another aspect, an embodiment of the present disclosure also provides an amorphous strip master alloy prepared by any of the above preparation methods.

DETAILED DESCRIPTION

For clearer descriptions of the technical solutions and advantages of the present disclosure, the embodiments of the present disclosure are described in detail as follows.

The amorphous strips can be used in many fields, for example they can be used in electrical equipment such as motors, transformers, or the like. However, the magnetic induction intensity (also known as B value) of the amorphous strips is not high, which limits the application thereof in the electrical equipment. For example, this may result in a large quantity of consumption of the amorphous strips, which will in turn lead to increased costs.

Therefore, it is very important to improve the magnetic induction intensity of the amorphous strips. Currently, there is no effective solution to improve the magnetic induction intensity of the amorphous strips.

In one aspect, an embodiment of the present disclosure provides a method for preparing an amorphous strip master alloy. The preparation method includes: providing an amorphous alloy and cementite $Fe_3C$, and placing the amorphous alloy and the cementite $Fe_3C$ in a smelting furnace for smelting treatment to obtain the amorphous strip master alloy. Here, elements constituting the amorphous alloy include Fe element, Si element and B element.

In the method for preparing an amorphous strip master alloy provided by the embodiment of the present disclosure, the amorphous alloy and cementite $Fe_3C$ are used as raw materials for co-smelting. During the smelting process, the addition of cementite $Fe_3C$ leads to the formation of the desired amorphous strip master alloy in the embodiments of the present disclosure. Due to the magnetism of the cementite $Fe_3C$, the magnetic induction intensity (also referred to as the magnetic flux density or B value) of the amorphous strip master alloy can be significantly improved. When the amorphous strip master alloy is used in preparing the amorphous strip, the magnetic induction intensity of the amorphous strip can also be significantly improved.

Further, the preparation method further includes placing the amorphous alloy, the cementite $Fe_3C$ and iron nitride $Fe_3N$ in the smelting furnace for smelting treatment.

By using the cementite $Fe_3C$ and the iron nitride $Fe_3N$ together, both the cementite $Fe_3C$ and the iron nitride $Fe_3N$ can be added to the amorphous alloy at the same time, which can further improve the magnetic induction intensity of the prepared amorphous strip master alloy.

During the addition, a mass ratio of the amorphous alloy, the cementite $Fe_3C$ and the iron nitride $Fe_3N$ may be 1:0.005-0.5:0.005-0.5.

As an example, the amorphous alloy may be an Fe—Si—B alloy. That is, the method for preparing an amorphous strip master alloy according to the embodiment of the present disclosure may include: providing an Fe—Si—B alloy and cementite $Fe_3C$, and placing the Fe—Si—B alloy and the cementite $Fe_3C$ in a smelting furnace for smelting treatment to obtain the amorphous strip master alloy.

By using the Fe—Si—B alloy and the cementite $Fe_3C$ as raw materials for co-smelting, during the smelting process, the Fe—Si—B alloy can be added with the magnetic cementite $Fe_3C$, so that the magnetic induction intensity of the obtained amorphous strip master alloy can be significantly improved. When the amorphous strip master alloy is used to prepare an amorphous strip, the magnetic induction intensity of the amorphous strip can also be significantly improved.

It can be understood that when the amorphous alloy is the Fe—Si—B alloy, the chemical general formula of the amorphous strip master alloy prepared from the above preparation method may be Fe—Si—B—$Fe_3C$.

In the embodiments of the present disclosure, on the premise that the magnetic induction intensity of the amorphous strip master alloy is increased, in order to ensure that the amorphous strip prepared by the amorphous strip master alloy has properties such as high strength, high hardness, high plasticity and the like, a mass ratio of the Fe—Si—B alloy to the cementite $Fe_3C$ is 1:0.005-0.5. For example, the mass ratio may be 1:0.005, 1:0.01, 1:0.05, 1:0.1, 1:0.15, 1:0.2, 1:0.25, 1:0.3, 1:0.35, 1:0.4, 1:0.45, 1:0.5, and the like.

The Fe—Si—B alloy and the cementite $Fe_3C$ as used are both common materials in the art. In the Fe—Si—B alloy, the atomic percentages of the respective elements contained therein may be as follows: Si 6 at %-12 at %, B 3 at %-14 at %, and the balance is Fe.

Further, in the Fe—Si—B alloy, the atomic percentages of the respective elements may also be as follows: Si 6 at %-12 at %, B 8 at %-14 at %, and the balance is Fe.

For example, the embodiments of the present disclosure may provide a Fe—Si—B alloy which includes elements in the following atomic percentages: Si 7 at %, B 8 at %, and the balance is Fe.

The embodiments of the present disclosure may also provide an Fe—Si—B alloy which includes elements in the following atomic percentages: Si 7 at %, B 9 at %, and the balance is Fe.

In another example, in addition to the inclusion of Fe element, Si element and B element, the elements constituting the amorphous alloy may further include at least one of Cu element, Nb element or Ni element.

For example, the amorphous alloy includes, but is not limited to Fe—Si—B—Nb alloy, Fe—Ni—Si—B alloy, or Fe—Cu—Nb—Si—B—Ni alloy.

As for the amorphous alloy in this example, a mass ratio of the amorphous alloy to the cementite $Fe_3C$ may be 1:0.005-0.5, so as to ensure that the amorphous strip prepared from the amorphous strip master alloy has the properties such as high strength, high hardness, high plasticity and the like under the premise that the magnetic induction intensity of the amorphous strip master alloy is increased. For example, the mass ratio of the amorphous alloy to the cementite $Fe_3C$ may be 1:0.005, 1:0.01, 1:0.05, 1:0.1, 1:0.15, 1:0.2, 1:0.25, 1:0.3, 1:0.35, 1:0.4, 1:0.45, 1:05, and the like.

As to the cementite $Fe_3C$, it may be provided by applying a cementite $Fe_3C$ finished product or by applying white iron. The white iron may be a better choice because it contains a large amount of cementite $Fe_3C$, and it has a low cost. Of course, it is also possible to use white iron and cementite $Fe_3C$ finished product together to provide the cementite $Fe_3C$. During the application, the white iron and/or the cementite $Fe_3C$ finished product may be placed in the smelting furnace together with the Fe—Si—B alloy for smelting.

In the embodiments of the present disclosure, the cementite $Fe_3C$ can be added during the smelting process. For example, the cementite $Fe_3C$ may be added to the smelting furnace containing the Fe—Si—B alloy.

As to the amorphous alloy, it may use ready-made finished products (e.g., conventional Fe—Si—B alloy finished products, or iron-based amorphous strips), or it may be prepared during the smelting process. Taking the Fe—Si—B alloy as an example, it may be obtained by direct smelting crystalline silicon, boron, and iron in the smelting furnace.

In the process of direct smelting crystalline silicon, boron and iron for preparing the Fe—Si—B alloy, the cementite $Fe_3C$ can be added to prepare the amorphous strip master alloy.

The cementite $Fe_3C$ added to the above examples may include a cementite $Fe_3C$ finished product and/or white iron.

In the smelting process, the Fe—Si—B alloy, the cementite $Fe_3C$ and the optional iron nitride $Fe_3N$ may be in a powder or block form.

In order to make the composition of the formed amorphous strip master alloy more uniform, in the embodiments of the present disclosure, the amorphous alloy, such as the Fe—Si—B alloy and the cementite $Fe_3C$, may be both in a powder form. In addition, a particle size of the powder may be controlled at a nanometer level, for example between 5 nanometers and 50 nanometers. For example, the particle size may be 10 nanometers, 15 nanometers, 20 nanometers, 25 nanometers, 30 nanometers, 35 nanometers, 40 nanometers, 45 nanometers or the like.

The Fe—Si—B alloy powder, which is also known as ultrafine crystalline alloy powder or nanocrystalline powder, and the cementite Fe3C powder may be obtained by crushing methods commonly used in the art.

Taking the Fe—Si—B alloy powder as an example, it may be obtained by the following methods:

performing embrittlement, heat treatment, mechanical crushing, and jet crushing on the iron-based amorphous alloy strip sequentially to obtain the Fe—Si—B alloy powder.

During the smelting treatment process, the smelting temperature is controlled to be in a range from 1300° C. to 1500°

C., such as 1300° C., 1350° C., 1400° C., 1450° C., 1500° C. or the like, so as to obtain a better smelting effect for the above amorphous alloy.

The smelting time is determined according to the amounts of the amorphous alloy and cementite, and may be in a range from 12 hours to 24 hours.

In another aspect, an embodiment of the present disclosure provides an amorphous strip master alloy prepared from any of the above preparation methods.

The amorphous strip master alloy provided by the embodiment of the present disclosure is obtained based on the addition of the cementite $Fe_3C$ to the amorphous alloy. Due to the magnetism of the cementite $Fe_3C$, the magnetic induction intensity (also referred to as the magnetic flux density or B value) of the amorphous strip master alloy can be significantly improved. When the amorphous strip master alloy is used in preparing the amorphous strip, the magnetic induction intensity of the amorphous strip can also be significantly improved.

As an example, the amorphous alloy includes, but is not limited to Fe—Si—B alloy, Fe—Si—B—Nb alloy, Fe—Ni—Si—B alloy, Fe—Cu—Nb—Si—B—Ni alloy, or the like.

The amorphous strip master alloys provided in the embodiments of the present disclosure can be used in preparing an amorphous strip with a high magnetic induction intensity.

When the amorphous strip master alloy according to the embodiment of the present disclosure is used to prepare an amorphous strip, a certain amount of cementite $Fe_3C$ can be applied again before the melt-spraying for remelting, and the remelting temperature is controlled to be between 1300° C. to 1400° C., which is more beneficial for improving the magnetic induction intensity of the amorphous strip.

In the methods according to the embodiments of the present disclosure, the amorphous alloy may be an iron-based amorphous alloy, and the method is also applicable to iron-nickel-based amorphous alloys and cobalt-based amorphous alloys. That is, the iron-nickel-based amorphous alloys or cobalt-based amorphous alloys may be smelted with cementite $Fe_3C$ in a certain proportion, and optional iron nitride $Fe_3N$, to obtain a corresponding master alloy.

The present disclosure will be further described by the following specific examples.

In an example, the Fe—Si—B alloy and the cementite $Fe_3C$ with a mass ratio of 1:0.05 were placed in the smelting furnace for smelting treatment, the smelting temperature was 1400° C., and an amorphous strip master alloy was obtained. The Fe—Si—B alloy as used included elements in the following atomic percentages: Si 9 at %, B13 at %, and the balance being Fe.

The magnetic induction intensity of the amorphous strip master alloy was measured by the magnetic flux meter sold by Lakeshore Company of the United States, and the measurement result showed that the magnetic induction intensity of the amorphous strip master alloy was 1.74 T.

In another example, the Fe—Si—B alloy and the cementite $Fe_3C$ with a mass ratio of 1:0.06 were placed in the smelting furnace for smelting treatment, the smelting temperature was 1450° C., and an amorphous strip master alloy was obtained. The Fe—Si—B alloy as used included elements in the following atomic percentages: Si 10 at %, B 10 at %, and the balance being Fe.

The magnetic induction intensity of the amorphous strip master alloy was measured by the magnetic flux meter sold by Lakeshore Company of the United States, and the measurement result showed that the magnetic induction intensity of the amorphous strip master alloy was 1.78 T.

In still another example, the Fe—Si—B alloy and the cementite $Fe_3C$ with a mass ratio of 1:0.08 were placed in the smelting furnace for smelting treatment, the smelting temperature was 1500° C., and an amorphous strip master alloy was obtained. The Fe—Si—B alloy as used included elements in the following atomic percentages: Si 9 at %, B 13 at %, and the balance being Fe.

The magnetic induction intensity of the amorphous strip master alloy was measured by the magnetic flux meter sold by Lakeshore Company of the United States, and the measurement result showed that the magnetic induction intensity of the amorphous strip master alloy was 1.82 T.

In yet another example, the Fe—Cu—Nb—Si—B—Ni alloy and the cementite $Fe_3C$ with a mass ratio of 1:0.1 were placed in the smelting furnace for smelting treatment, the smelting temperature was 1500° C., and an amorphous strip master alloy was obtained. The Fe—Cu—Nb—Si—B—Ni alloy as used included elements in the following atomic percentages: Si 9 at %, B 13 at %, Cu 3 at %, Nb 2 at %, Ni 1 at % %, and the balance being Fe.

The magnetic induction intensity of the amorphous strip master alloy was measured by the magnetic flux meter sold by Lakeshore Company of the United States, and the measurement result showed that the magnetic induction intensity of the amorphous strip master alloy was 1.80 T.

In yet another example, the Fe—Ni—Si—B alloy and the cementite $Fe_3C$ with a mass ratio of 1:0.1 were placed in the smelting furnace for smelting treatment, the smelting temperature was 1500° C., and an amorphous strip master alloy was obtained. The Fe—Ni—Si—B alloy as used included elements in the following atomic percentages: Si 9 at %, B 13 at %, Ni 5 at %, and the balance being Fe.

The magnetic induction intensity of the amorphous strip master alloy was measured by the magnetic flux meter sold by Lakeshore Company of the United States, and the measurement result showed that the magnetic induction intensity of the amorphous strip master alloy was 1.81 T.

It can be seen from the above detailed examples that the magnetic induction intensity of the amorphous strip master alloy prepared from the preparation method according to the embodiments of the present disclosure is significantly improved.

Described above are merely preferred embodiments of the present disclosure, but are not intended to limit the present disclosure. Within the spirit and principles of the disclosure, any modifications, equivalent replacements, improvements and the like shall be covered by the protection scope of the present disclosure.

What is claimed is:

1. A method for preparing an amorphous strip master alloy, comprising:

providing an amorphous alloy and cementite $Fe_3C$; and placing the amorphous alloy and the cementite $Fe_3C$ in a smelting furnace for smelting treatment to obtain the amorphous strip master alloy, wherein elements constituting the amorphous alloy comprise Fe element, Si element and B element.

2. The method for preparing the amorphous strip master alloy according to claim 1, further comprising:

providing iron nitride $Fe_3N$; and placing the amorphous alloy, the cementite $Fe_3C$ and the iron nitride $Fe_3N$ in the smelting furnace for smelting treatment.

3. The method for preparing the amorphous strip master alloy according to claim 1, wherein the amorphous alloy is an Fe—Si—B alloy.

4. The method for preparing the amorphous strip master alloy according to claim 1, wherein the elements constituting the amorphous alloy further comprise at least one of Cu element, Nb element or Ni element.

5. The method for preparing the amorphous strip master alloy according to claim 4, wherein the amorphous alloy is an Fe—Si—B—Nb alloy.

6. The method for preparing the amorphous strip master alloy according to claim 4, wherein the amorphous alloy is an Fe—Ni—Si—B alloy.

7. The method for preparing the amorphous strip master alloy according to claim 4, wherein the amorphous alloy is an Fe—Cu—Nb—Si—B—Ni alloy.

8. The method for preparing the amorphous strip master alloy according to claim 4, wherein a mass ratio of the amorphous alloy to the cementite $Fe_3C$ is 1:0.005-0.5.

9. The method for preparing the amorphous strip master alloy according to claim 3, wherein a mass ratio of the Fe—Si—B alloy to the cementite $Fe_3C$ is 1:0.005-0.5.

10. The method for preparing the amorphous strip master alloy according to claim 1, wherein a smelting temperature is in a range of 1300° C. to 1500° C. during the smelting treatment.

11. The method for preparing the amorphous strip master alloy according to claim 1, wherein the cementite $Fe_3C$ is provided by using a cementite $Fe_3C$ finished product or white iron.

12. The method for preparing the amorphous strip master alloy according to claim 1, wherein the cementite $Fe_3C$ is provided by simultaneously using white iron and a cementite $Fe_3C$ finished product.

13. The method for preparing the amorphous strip master alloy according to claim 3, wherein, in the Fe—Si—B alloy, atomic percentages of the respective elements are as follows:

Si 6 at %-12 at %, B 3 at %-14 at %, and the balance being Fe.

14. The method for preparing the amorphous strip master alloy according to claim 13, wherein, in the Fe—Si—B alloy, the atomic percentages of the respective elements are as follows:

Si 6 at %-12 at %, B 8 at %-14 at %, and the balance being Fe.

15. The method for preparing the amorphous strip master alloy according to claim 2, wherein the amorphous alloy, the cementite $Fe_3C$, and the iron nitride $Fe_3N$ are in a powder or block form.

16. The method for preparing the amorphous strip master alloy according to claim 15, wherein a particle size of the powder is at nanometer level.

17. The method for preparing the amorphous strip master alloy according to claim 16, wherein the particle size of the powder is in a range of 5 nanometers to 50 nanometers.

18. The method for preparing the amorphous strip master alloy according to claim 15, wherein the amorphous alloy is an Fe—Si—B alloy.

19. The method for preparing the amorphous strip master alloy according to claim 18, wherein the Fe—Si—B alloy powder is obtained by:

performing embrittlement, heat treatment, mechanical crushing, and jet crushing on an iron-based amorphous alloy strip sequentially to obtain the Fe—Si—B alloy powder.

* * * * *